US006811000B1

(12) United States Patent
Granata

(10) Patent No.: US 6,811,000 B1
(45) Date of Patent: Nov. 2, 2004

(54) VOLUMETRIC OPERATING SYSTEM FOR VEHICLE LIFTS

(75) Inventor: Tebaldo Granata, Treglio (IT)

(73) Assignee: Snap-On Incorporated, Lincolnshire, IL (US)

( * ) Notice: Subject to any disclaimer, the term of this patent is extended or adjusted under 35 U.S.C. 154(b) by 0 days.

(21) Appl. No.: 09/807,595

(22) PCT Filed: Oct. 12, 1999

(86) PCT No.: PCT/IB99/01778

§ 371 (c)(1),
(2), (4) Date: Jul. 11, 2001

(87) PCT Pub. No.: WO00/21871

PCT Pub. Date: Apr. 20, 2000

(30) Foreign Application Priority Data

Oct. 15, 1998 (IT) ..... MI98A2217

(51) Int. Cl.[7] ..... B66F 7/08

(52) U.S. Cl. ..... 187/274; 187/213; 187/215; 91/520; 254/89 H

(58) Field of Search ..... 187/203, 211, 187/215, 269, 272, 274; 91/520, 181, 172; 254/89 H

(56) References Cited

U.S. PATENT DOCUMENTS 4,691,805 A * 9/1987 Kishi ..... 187/275
4,741,413 A * 5/1988 Kishi ..... 187/269 X
6,026,934 A * 2/2000 Deurloo ..... 187/274

* cited by examiner

*Primary Examiner*—Eileen D. Lillis
*Assistant Examiner*—Thuy V. Tran
(74) *Attorney, Agent, or Firm*—Davidson Berquist Klima & Jackson LLP

(57) ABSTRACT

A description is provided of a volumetric operating system (10) for scissors-type vehicle lifts, comprising a plurality of cylinders (16, 18, 20, 22) for movement of the vehicle lifting runways (12, 14), of which the main cylinders (16, 22) receive the operating fluid directly from supply means (24, 28, 30), and the secondary cylinders (18, 20) receive the operating fluid from the outlet (32, 34) of a respective one of the main cylinders (16, 22), wherein with each runway (12, 14) there is associated at least one of the said main cylinders (16, 22), and at least one of the said secondary cylinders (18, 20). Preferably, the outlet of each main cylinder (16, 22) which is associated with one of the runways (12, 14) supplies a secondary cylinder (18, 20) which is associated with the other runway (12, 14).

1 Claim, 1 Drawing Sheet

VOLUMETRIC OPERATING SYSTEM FOR VEHICLE LIFTS

BACKGROUND OF THE INVENTION

The present invention relates to vehicle lifts, in particular of the scissors type. In the following description, scissors-type lifts mean in general scissors- and double-scissors-type lifts, in which, when the scissors are closed, the lift is lowered to ground level, and when the scissors are open, the lift is raised, and inverted-and double-inverted-scissors-type lifts, in which the scissors open beneath ground level, in order to lower the lift, and are closed at ground level in order to raise the lift, optionally with the assistance of pistons or rack-type mechanisms.

The FR-A-1 575 128 discloses a scissors-type vehicle lift comprising a volumetric operating system in which two cylinders move a vehicle lifting runway. A main cylinder receives the operating fluid directly from supply means, and a secondary cylinder receives the operating fluid from the outlet of the main cylinder, whereby with the runway there is associated the main cylinder and the secondary cylinder.

Scissors-type lifts have been developed in which, in order to move the lift, a pair of cylinders is provided for each of the lifting scissors of the runways. The known operating system for the cylinders is of the serial type, i.e. in a first runway there are disposed the main cylinders, the outlet of which supplies the secondary cylinders which are associated with the other runway. This arrangement requires temporally staggered raising of the two runways, and thus gives rise to a loss of parallelism of the vehicle relative to the ground. In addition, the force on the pair of cylinders is asymmetrical, with all the resulting problems.

SUMMARY OF THE INVENTION

The object of the present invention is thus to provide a volumetric operating system for vehicle lifts, in particular of the scissors type, which permits synchronized movement of the runways.

This problem is solved remarkably well by means of a volumetric operating system according to the present invention, for vehicle lifts. Further advantageous characteristics of the said system are indicated hereinafter.

BRIEF DESCRIPTION OF THE DRAWINGS

The characteristics, objects and advantages of the present invention will become more apparent from the following description and from the attached drawings relative to a non-limiting embodiment. In the various figures.

DETAILED DESCRIPTION

Figure 1:
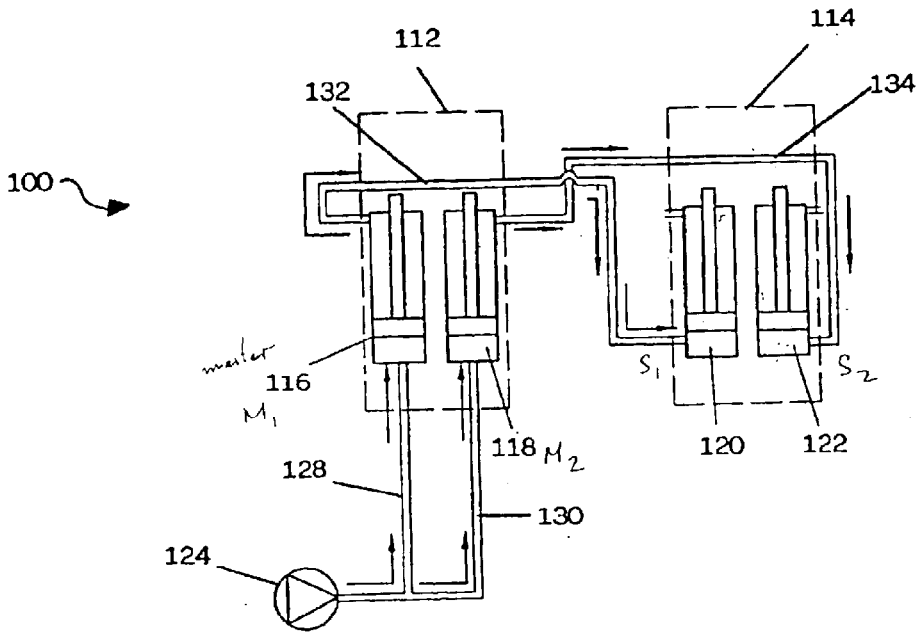
Fig. 1 PRIOR ART
FIG. 1 is a schematic view of the volumetric operating system for lifts according to the prior art.

With reference firstly to FIG. 1, a volumetric operating system 100 for scissors-type vehicle lifts has firstly two runways 112, 114. With each runway there is associated at least one pair of scissors (not shown), which is controlled by a respective pair of cylinders 116, 118 and 120, 122. Pressurized fluid, for example oil, air or liquid, is supplied via a valve 124 and two pipes 128 and 130 to the two cylinders 116 and 118 which are associated with the first runway 112. It will be appreciated that upstream from the valve 124, there are present the corresponding command and control components, which are not described in detail, since they are not relevant for the purposes of the present invention. Two pipes 132, 134 supply respectively to the two cylinders 120, 122 which are associated with the second runway 114, the fluid output from the rod chamber of the cylinders 116, 118. In other words, the system 100 is of the serial type, in which, with the first runway 112 there are associated the main cylinders 116, 118, and with the second runway 114 there are associated the secondary cylinders 120, 122. However, since in a volumetric system the main cylinders tend to fill before the secondary cylinders, in the case of the device in FIG. 1, the runway 112 tends to rise before the runway 114. Consequently, the vehicle is not raised perfectly parallel to the ground, and the force on the pairs of cylinders is asymmetrical, with all the resulting problems.

Figure 2:
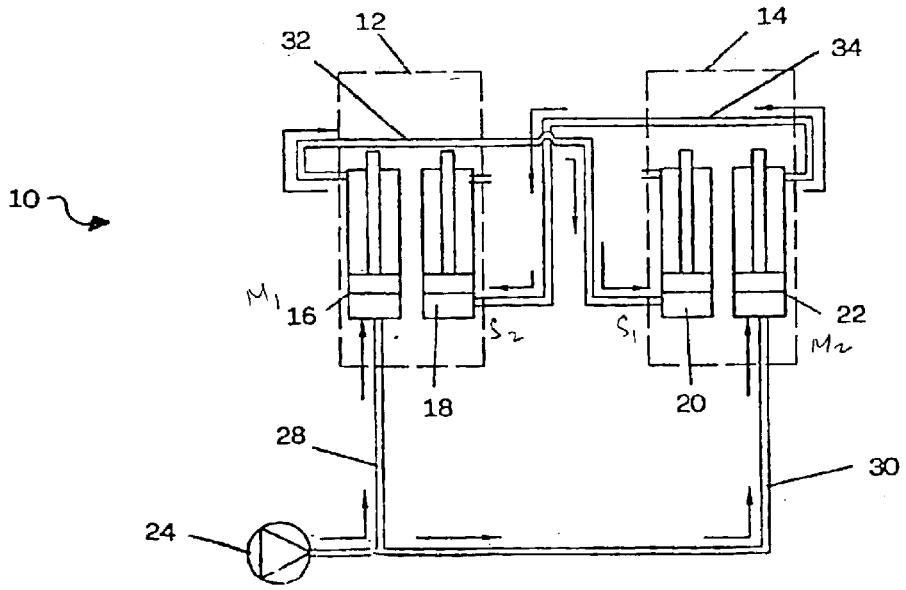
FIG. 2 is a schematic view of the volumetric operating system for lifts according to the present invention.

FIG. 2 illustrates a volumetric operating system 10 according to the invention, for scissors-type vehicle lifts, in which the components of the system 10 which correspond to those of the system 100 in FIG. 1 have corresponding reference numbers, but reduced by 100. Thus, with each runway 12, 14, there is associated at least one pair of scissors (not shown), which is controlled by a respective pair of cylinders 16, 18 and 20, 22. However, according to the present invention, the pressurised fluid is supplied via a valve 24 and two pipes 28, 30, to the cylinder 16 which is associated with the first runway 12, and to the cylinder 22 which is associated with the second runway 14. The outlet of the rod chamber of the cylinders 16, 22 is connected by means of two pipes 32, 34 respectively, to the cylinder 20 which is associated with the second runway 14, and to the cylinder 18 which is associated with the first runway 12. The system 10 is thus of the cross-type, in which the main cylinders 16, 22 and the secondary cylinders 18, 20 are associated, one with each runway 12, 14. Consequently, according to the invention, the two runways 12, 14 are raised simultaneously with the filling of the main cylinders 16, 22, and the temporal staggering of operation of the secondary cylinders 18, 20 does not have significant consequences on the movement of the runways 12, 14. The vehicle is thus raised in a manner which is perfectly parallel to the ground, and the force on the pairs of cylinders which are associated with the two runways is perfectly symmetrical.

Finally, it should be noted that, although the arrangement illustrated in FIG. 2 is optimal from the point of view of synchronisation and automatic control of the movement of the runways, satisfactory results can also be obtained by providing a pair consisting of a main cylinder and a secondary cylinder associated for each runway. Finally, it will be apparent to persons skilled in the art that the design characteristics of the cylinders are irrelevant, provided that the main cylinders have an outlet for the fluid which can be used to supply the secondary cylinders. In addition, it will be appreciated that the basic principle of the invention can be extended to any number of pairs of cylinders, and it must thus be considered that numerous modifications, adaptations, integrations, variants and substitutions can be made to the embodiment previously described by way of illustrative, non-limiting example, without departing from the context of the invention, as determined by the following attached claims.

What is claimed is:

1. A vehicle lift comprising:

a plurality of vehicle lifting runways;

a volumetric operating system including an operating fluid supply, a pair of main cylinders and a pair of secondary cylinders that cooperate to move the vehicle lifting runways, wherein the pair of main cylinders receive operating fluid directly from the operating fluid supply; and each of the secondary cylinders receive operating fluid indirectly from an operating fluid outlet of a respective one of the main cylinders, and wherein each runway includes one of said main cylinders and one of said secondary cylinders wherein the operating fluid outlet of each main cylinder, which is associated with one of the plurality of vehicle lifting runways, supplies a secondary cylinder which is associated with another of the plurality of vehicle lifting runways so that each of the runways will move in parallel.

* * * * *